United States Patent [19]

Bianchetta et al.

[11] 3,943,825

[45] Mar. 16, 1976

[54] HYDRAULIC CONTROL SYSTEM FOR LOAD SUPPORTING HYDRAULIC MOTORS

[75] Inventors: Donald L. Bianchetta, Coal City; Kenneth R. Lohbauer, Joliet; Sammy J. Rhodes, Aurora, all of Ill.

[73] Assignee: Caterpillar Tractor Co., Peoria, Ill.

[22] Filed: Oct. 26, 1973

[21] Appl. No.: 409,869

Related U.S. Application Data

[62] Division of Ser. No. 244,822, April 17, 1972, Pat. No. 3,805,678.

[52] U.S. Cl. ..... 91/438; 91/445; 91/447; 91/461; 137/596.15

[51] Int. Cl.[2] ..... F15B 11/08; F15B 13/042

[58] Field of Search ..... 91/445, 447, 444, 461, 91/304, 438; 137/596.15, 596.18

[56] References Cited

UNITED STATES PATENTS

| | | | |
|---|---|---|---|
| 2,459,902 | 1/1949 | Tucker | 91/444 X |
| 2,618,121 | 11/1952 | Tucker | 91/447 X |
| 2,750,743 | 6/1956 | Korkowski et al. | 91/447 X |
| 3,049,101 | 8/1962 | Ruhl | 91/447 X |
| 3,087,467 | 4/1963 | Gresko | 91/424 |
| 3,127,688 | 4/1964 | Hein et al. | 91/445 X |
| 3,211,065 | 10/1965 | Hunger et al. | 91/461 X |
| 3,557,829 | 1/1971 | Finley | 91/461 X |
| 3,606,820 | 9/1971 | Thomas | 91/444 X |

*Primary Examiner*—Irwin C. Cohen
*Attorney, Agent, or Firm*—Phillips, Moore, Weissenberger Lempio & Strabala

[57] ABSTRACT

A load supporting hydraulic system having a pilot operated main control valve is provided with pilot controlled load check valve operative to permit free flow of fluid from said control valve toward the load supporting means of the system in response to pilot pressure and to block fluid flow from the load supporting means toward the control valve. The system includes valve means operative independent of the main control valve to permit the load check valve to be opened by fluid pressure in the load supporting means to allow fluid flow therefrom to the reservoir. The system further includes safety valve means for blocking fluid flow to pilot control means.

6 Claims, 2 Drawing Figures

33
39a
39
40
32
31
34
121
G
114
E
D
122
H
35
13
F
123
113
119
116
117
112
36
37
13
12
13
90
93
14
15
B
A
C
23
94
97
106a
106
108
111
109
104
102
99
110
107
100
103
98
95
86
87
96
17
85
19
20
89
1
21
42
43
47
50
46
53
45
44
51
55
54
11
10
10a
9
7
6
4
2
5
3
8
9
65
71
70
48
69
68
74
60
57
67
76
81
61
62
64
72
75
78
63
59
66
79
83
80
58
49

HYDRAULIC CONTROL SYSTEM FOR LOAD SUPPORTING HYDRAULIC MOTORS

This is a division, of Ser. No. 244,822, Filed April 17, 1972 now Pat. No. 3,805, 678.

BACKGROUND OF THE INVENTION

Hydraulic and other similar fluid control circuits are commonly used in applications wherein a fluid motor is utilized for substantially vertical elevational adjustment of relatively large loads and is at times required to support the load in an elevated position. This type of application results in several problems with respect to the desired function under all conditions as well as safety to the equipment, operator, and service personnel.

For example, most such systems use a sliding spool directional control valve in which the spool must have a radial operating clearance with a bore in the valve body to permit relatively free movement of the spool. When the motor is required to support the load in an elevated position, the annular clearance between the spool and the valve bore provides a leakage path which can result in downward drifting of the load. One solution to this leakage problem is to interpose a poppet type load check valve between the load supporting end of the fluid motor and the control valve to isolate the load supporting pressure from the control valve as disclosed in U.S. Pat. No. 3,127,688 the Hein, et al. When it is desired to lower the load, it is necessary to permit the load check valve to open so that fluid may be displaced from the load supporting end of the motor. This is accomplished in Hein, et al by venting the load check valve across the directional control valve spool when the control spool is actuated to a load lowering position. This has the disadvantages of increasing the overall length of a rather large, expensive control valve and further requires precise machining therein to provide the proper timing relationship of the vent ports in the valve body to the vent grooves in the control spool to insure that the load check is vented only when it is desired to lower the load.

It is also necessary to permit opening of the load check valve when it is necessary to lower the load in the absence of fluid pressure in the system due to a stalled engine or a failure in the control circuit. although the Hein, et al system has this capability with a manually actuated control spool as depicted therein, such system would be operative in a control system utilizing a pilot actuated control spool. In pilot actuated control systems, when pilot pressure fails it is neccessary to bypass the main control spool for returning fluid from the load supporting end of the motor to the reservoir, since pilot pressure will not be available for shifting the control spool to the load lowering position.

Another serious problem attendant to pilot actuated systems, when pressure is available in the pilot control circuit, is inadvertent actuation of the pilot valve to an operative position, which can result in unwanted movement of the load. Such inadvertent actuation of the control system could result in damage to the mechanism being actuated by the fluid motor or serious injury to any persons in the area of the equipment.

SUMMARY OF THE INVENTION

Accordingly, it is an object of this invention to provide control system for load supporting fluid motors that overcomes the above problems of the prior art.

Another object of this invention is to provide an improved fluid control system for load supporting fluid motors having positive leakage control and yet provide safe functional control of the load under both operative and inoperative conditions.

Another object of this invention is to provide an improved fluid control system for load supporting fluid motors so as to achieve the desired operational characteristics in both operative and inoperative conditions of the circuit in a manner which is safe for the vehicle and personnel in the immediate area with a minimum of expense and without undue complication of the main control valve.

Other objects and advantages of the present invention will become more readily apparent upon reference to the accompanying drawings and following description.

DESCRIPTION OF THE PREFERRED EMBODIMENTS

Figure 1:
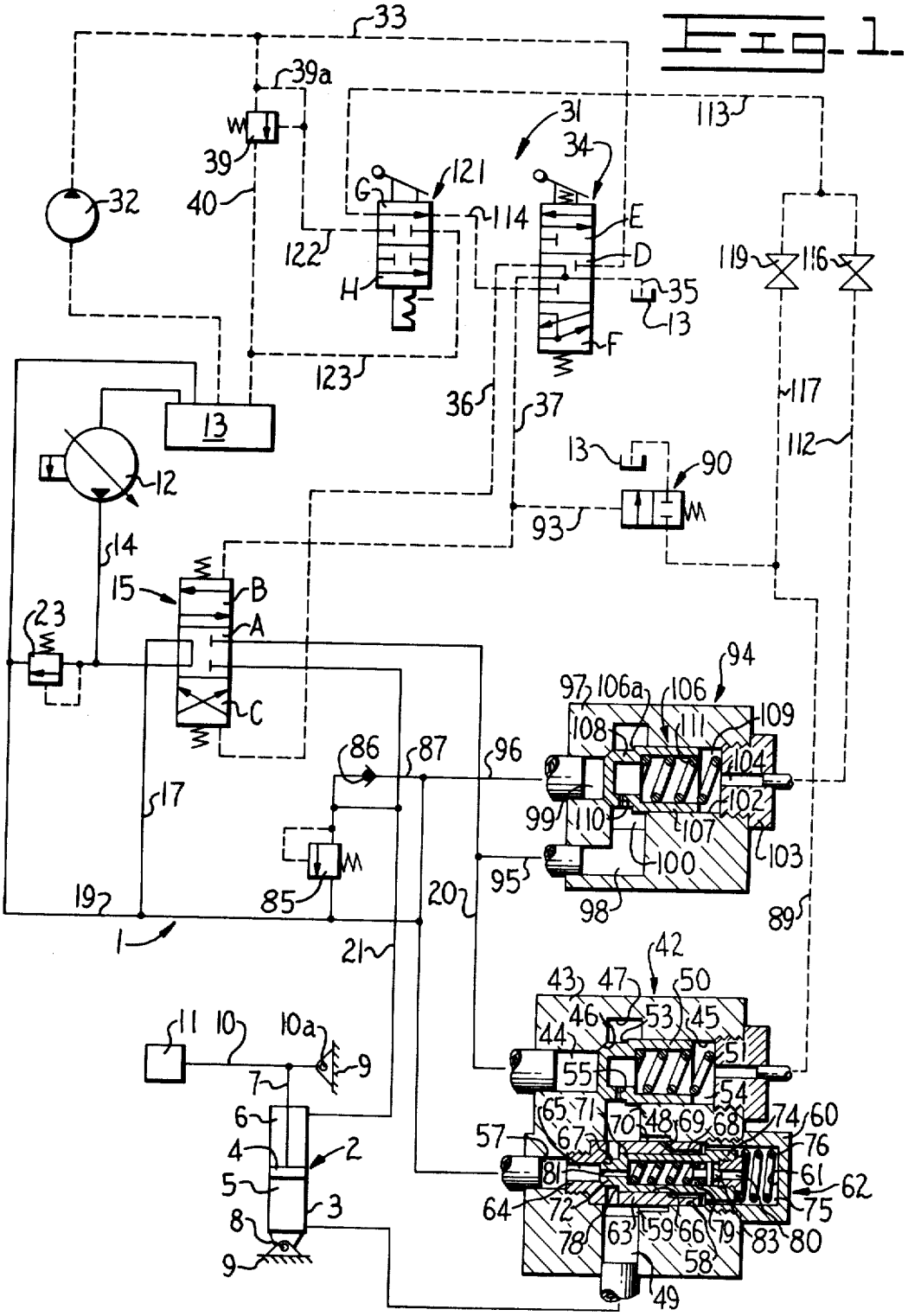
FIG. 1 is a schematic diagram of a fluid control circuit embodying the principles of the present invention with certain valves depicted in longitudinal cross-section.

Referring now to the drawings, and more particularly to FIG. 1, there is schematically illustrated a fluid control system embodying the principles of the present invention, generally indicated by the reference numeral 1, operatively connected to control a load supporting fluid motor 2. The motor includes a cylinder 3 having a piston 4 reciprocally mounted therein to define a head end chamber 5 and a rod end chamber 6. A rod 7 has its inner end secured to the piston and extends outwardly of the cylinder. The head end of the motor is pivotally supported as indicated at 8 to a base or vehicle 9 with the outer end of the rod connected intermediate the ends of a load supporting arm 10. A load 11 which may be representative of an implement mounted on a vehicle is mounted at the outer end of the load supporting arm 10 which has its other end pivotally supported at 10*a* to the base or vehicle 9. The system of the present invention is particularly adapted for machines such as hydraulic loaders and excavators.

The control system includes a pump 12 which draws fluid from a reservoir 13 for supply through a line 14 to a pilot operated main control valve 15 which is selectively positionable between a neutral or hold position A and either one of two operative positions B and C. The control valve 15 communicates with the reservoir 13 by way of a line 17 and a main return line 19. The control valve further communicates with a load supporting or head end of the motor 2 by way of a line 20 and with an opposite or rod end of the motor by way of a line 21. A relief valve 23 selectively controls communication between the pump output line 14 and return line 19 to limit the maximum pressure in the control system.

A pilot control system indicated generally at 31 for operation of valve 15 includes a pump 32 which draws fluid from reservoir 13 for supply through a line 33 to a pilot control valve indicated generally at 34. The pilot control valve communicates with the reservoir by way of a line 35 and further communicates with the opposite ends of the main control valve by way of the pilot lines 36 and 37.

The pilot control valve 34 has a neutral position designated D at which the pilot lines 36 and 37 are in communication with the reservoir and the pump output line 33 is blocked. The pilot valve 34 also has two operative positions designated E and F which are effective to alternately communicate the pump to one end of the valve 15 while communicating the opposite end of that valve with the reservoir for actuation of the main control valve to either of its operative positions B or C. A pressure responsive relief valve 39, pilot operated by a control line 39*a*, controls communication between the pump output line 33 and the reservoir by way of a line 40 to limit the maximum pressure in the pilot system to a predetermined level.

When the load 11 is stopped in an elevated position such that it must be supported by the motor 2, fluid pressure in the head end of the motor must be positively retained to avoid downward drift of the load due to leakage. Most control valves such as that schematically depicted at 15 are of the sliding spool type which necessarily include an annular clearance between the valve spool and the body to permit relatively free movement of the spool. This annular clearance permits leakage which is unacceptable in load supporting situations of this type, in that it permits downward drifting of the load as such leakage occurs.

In order to provide positive leakage control for the load supporting end of the motor, a load check valve indicated generally at 42 is disposed in line 20 intermediate the head end of the motor and the main control valve 15. The load check valve includes a body 43 having a port 44 which communicates with a valve bore 45. The port 44 terminates at its inner end with a chamfered seat 46. An annular groove 47 is interposed the inner ends of the port 44 and the bore 45 for communication therewith and communicates through a passage 48 with a port 49. The port 44 is in communication with the main control valve 15, whereas port 49 communicates directly to the load supporting end of the motor 2.

The load check valve 42 comprises a valve member 50 disposed in the valve bore 45 and is resiliently biased by a spring 51 toward the port 44 for a sealing seated engagement with the seat 46. When the check valve is seated as illustrated, it blocks communication between the ports 44 and 49 to isolate the load supporting pressure in the motor from the control valve to prevent leakage from the motor therethrough. The check valve 50 further includes a stepped outer diameter providing a shoulder 53 which is exposed to the load supporting pressure in the annular groove 47. The load supporting pressure acting on the shoulder generates a valve opening force opposing the bias of the spring 51 and urges the check valve away from the chamfered seat. Restricted communication between the annular groove 47 and the valve bore 45 behind the check valve which portion constitutes a control chamber 54, is provided by an orifice 55 in the check valve. The orifice is in constant registry or communication with the annular groove 47. This permits the load supporting pressure in the head end of the motor to assist spring 51 in urging the check valve toward a closed position since the area of the check valve exposed to the pressure in chamber 54 is greater than that of the shoulder 53. When the pressure is relieved from chamber 54, the higher pressure acting on shoulder 53 overcomes the spring pressure, forcing valve element away from its seat 46, as will be explained below.

The valve body 43 further includes a return port 57 and a valve bore 58 disposed in coaxial relation to the return port. An annular groove 59 is formed in the body in encircling relation to the valve bore and is further disposed in communicating relation between the passage 47 and the port 49. A threaded plug 60 threadably engages the outer end of the bore 58 and includes an inwardly facing recess 61. Since the motor 2 is subject to external forces acting thereon which may result in excessive pressure in the head end of the motor, a relief valve indicated generally at 62 is disposed in the body 43 between the load check valve 50 and the load supporting end of the motor.

The relief valve 62 includes a cartridge 63 having an inner end 64 threadably secured to the body. The cartridge includes a passage 65 communicating between the return port 57 and a valve bore 66 with the intersection therebetween being defined by a conical seat 67. The valve bore 66 terminates at the opposite end of the cartridge with a counterbore 68, which is communicated by an orifice 69 with the annular groove 59 by way of an annular relief 70 in the bore 58. A relief dump spool 71 is slidably mounted in bore 66 and includes a seating end 72 for selective sealing engagement with seat 67.

An outer biasing end of the spool 71 forms, with the recess 61 in the plug, a control chamber 75. A spring 76 is disposed in the control chamber in biasing relation to the biasing end 74 of the spool to urge the spool into sealin contact with the seat 67 normally to block communication between the return port and the annular groove 59.

The seating end 72 of the spool 71 is of relatively smaller diameter than the body of the spool, thus forming a shoulder 78 exposed to fluid pressure in the annular groove 59. The spool 71 further includes a central chamber 79 which communicates through a passage 80 with the control chamber 75. The chamber 79 also communicates through a passage 81 with the return port 57 by way of the passage 65. The passages 80 and 81 are relatively larger than the orifice 69 so that fluid flow therethrough will result in a differential pressure across the orifice. A spring biased poppet 83 is disposed in the chamber 79 and is urged into closing relation with the passage 80 normally to block communication between the chamber 75 and the return port.

A motor line relief valve 85 is substantially identical to the relief valve 62 and is disposed in pressure limiting relationship between the motor line 21 and the return line 19 to limit the maximum pressure in the rod end of the motor and the associated motor line. An anticavitation check valve 86 is disposed in a line 87 communicating between the return line and the motor line to allow make up fluid flow to the motor line at any time the pressure is motor line is lower than the pressure in the return line.

When the main control valve 15 is actuated to position B to communicate fluid pressure to the rod end of motor 2, it is necessary that the check valve 50 be opened to allow fluid displaced from the head end of the motor to return to the reservoir. For this purpose, a vent line 89 provides communication between the control chamber 54 and a normally closed vent valve indicated schematically at 90. The valve 90 is normally biased to the position shown to block communication between the line 89 and the reservoir 13. Pilot line 37 communicates with the valve 90 by way of a line 93 such that pressure in the pilot line is effective to urge the valve toward an open position. This communicates the vent line and the control chamber to the reservoir.

An anti-cavitation valve 94 is disposed in fluid communication controlling relation between the motor line 20 and the return line 19. A line 95 communicates between the valve 94 and the motor line 20 with a line 96 communicating between the anti-cavitation valve and the return line. The anti-cavitation valve includes a body 97 with means defining an outlet port 98 and an inlet port 99 which are interconnected by an annular groove 100. The valve body further defines a valve bore 102 coaxially aligned with port 99 and separated therefrom by the annular groove. The valve bore has an open outer end which is closed by a threaded plug 103 which includes a vent port 104. A check valve member 106 is reciprocally disposed in the valve bore and includes a body portion 107 and a valving portion 108 of relatively smaller diameter which is adapted to seat in the end of an inlet port 99. The check valve, plug 103, and valve bore 102 cooperate to define a control chamber 109 opposite the valving portion 108. An orifice 110 in the check valve provides restricted communication between the groove 100 and the control chamber. A spring 111 is disposed in the control chamber in biasing relation to the check valve to urge it into sealing engagement with the inner end of the inlet port to block communication between the inlet port and the outlet port.

Control chamber 109 is communicated through a line 112, a line 113, a line 114, and return line 35 to reservoir 13. In order to control communication between the control chamber and the reservoir, a manually actuated normally closed valve 116 is disposed in the line 112 and may be selectively opened to vent the control chamber to the reservoir. In like manner, the line 89 communicating with control chamber 54 of valve 42 is communicable with the reservoir 13 by way of a line 117 and lines 113, 114 and 35. A manually controlled normally closed valve 119 is disposed in the line 117 for selectively controlling communication between control chamber 54 and the reservoir.

Means to prevent inadvertent actuation of the control valve, such as when the operator is mounting or dismounting the vehicle, is desirable since this unwanted movement could result in damage to the load or implement or injury to personnel in the area. For this purpose, a manually actauted safety valve 121 is disposed in fluid controlling relation between a line 122 communicating with the pilot control line 39*a* and a line 123 communicating with the reservoir. When the pilot system is operative, the safety valve is spring biased to a closed position G, as shown, to block communication between the lines 122 and 123 so as to render pilot relief valve 39 functional to maintain pressure in the pilot system.

When it is desired to disable the pilot system, such as when the operator is dismounting the machine, the safety valve is actuated to a position H. This is effective to establish communication between the lines 122 and 123 to vent the relief valve and permit it to open at a relatively low pressure and direct the output of pump 32 to the reservoir by way of the line 40. The pressure required to open the relief valve under these conditions is not sufficient to actuate the valve element of main control valve 15 and the pilot system is rendered inoperative. Inadvertent operation of the motor 2 and resultant movement of load 11 is thus prevented.

Since the manually controlled valves 116 and 119 would normally be located remote from the operator station, it is desirable to provide additional control for venting of the control chambers 54 and 109. For this purpose, line 113 communicates with safety valve 121 such that the safety valve controls communication between the lines 113 and 114. When the safety valve 121 is in the position shown, the line 113 is communicated to the line 114 whereas movement of the safety valve to position H blocks communication between the lines. Line 114 is further connected to pilot valve 34 and is blocked from communication with return line 35 and the reservoir when the pilot valve is in the neutral D position shown.

Figure 2:
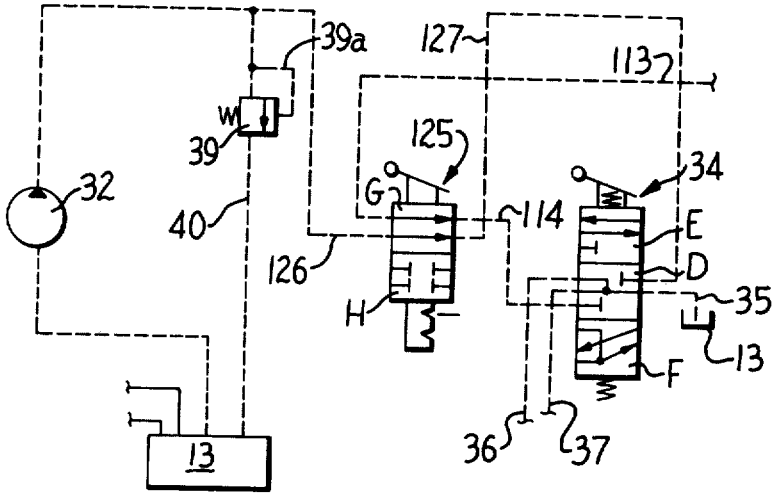
FIG. 2 is a schematic of a modified pilot circuit for the system of FIG. 1.

Referring now to FIG. 2, there is illustrated an alternate embodiment of a pilot system for the system of the present invention. The pilot system of FIG. 2 differs from that of FIG. 1 in that the safety valve is operative to cut off entirely the supply of fluid of the pilot system. The pilot system of FIG. 1, on the other hand, is operative to vent the pilot fluid to tank and thereby reduce the pilot pressure to an inoperative level. In either case, the safety valve functions to render the pilot system inoperative.

Identical elements in the FIG. 2 embodiment are identified by the same reference numerals, as in the previous embodiment. A comparison of the embodiments of FIG. 1 and FIG. 2 will disclose that the pilot supply line 33 (FIG. 1) is now controlled by new safety valve 125 (FIG. 2) and becomes new supply lines 126 and 127. The safety valve 125 operates in the G position to provide communication of pilot fluid by way of lines 126 and 127 to the pilot control valve 34. Communication is also established between lines 113 and 114 in this position (G) as in the previous embodiment.

When the safety valve 125 is positioned in the H position, communication between lines 126 and 127 is blocked so that the supply of pilot fluid to the pilot system is entirely cut off. This renders the pilot system inoperative so that inadvertent movement of valve 34 will not result in movement of the load supporting implement. When the system is in this condition, pilot fluid is returned by way of relief valve 39 to sump 13. In all other respects the entire system remains the same.

OPERATION

While the operation of the present invention is believed apparent from the foregoing description, further amplification will be made in the following summary. With respect to the FIG. 1 embodiment, with the vehicle engine running, such that fluid pressure is available in pilot circuit 31 and motor control circuit 1, the operator mounts the vehicle and shifts the safety valve 121 to the position shown. This blocks communication between lines 122 and 123 such that the relief valve 39 is functional to establish pilot pressure in the supply line 33 to make the pilot system operational.

When the operator desires to adjust the elevational position of load 11 upward, he shifts pilot valve 34 to its operative position E to communicate pilot supply line 33 to the lower end of control valve 15 by way of pilot line 36. This moves the control valve to position C to communicate the pump 12 with the head end of the motor 2 by way of the motor line 20 and the load check valve 50. As the motor is extended, the fluid displaced from the rod end 6 is returned to the reservoir by way of the motor line 21, control valve 15, line 17, and the return line 19.

Lowering of the load by retraction of the motor is accomplished by moving the pilot valve to its position F for communicating the output of the pilot pump 32 through the pilot line 37 to the upper end of the valve 15 as viewed in the drawing. This moves the main control valve to its B position to communicate the output of pump 12 with the rod end of the motor to lower the load 11. Since the load check valve element 50 normally blocks flow from the head end of the motor forward the main control valve, it is necessary to permit that check valve to open so that fluid displaced from the head end of the motor may return to the reservoir. For this purpose, the pilot pressure in pilot line 37 is communicated through line 93 to shift the valve 90 to establish communication between the control chamber 54 by way of vent line 89 and the reservoir 13. Since fluid is permitted to flow out of the control chamber 54 at a faster rate than the fluid entering the control chamber by way of the orifice 55, a pressure differential is generated across the orifice. The higher pressure in the annular groove 47 acts on the shoulder 53 of the check valve to urge it toward an open position in opposition to the bias of the spring 51. This establishes communication between the head end of the motor and the port 44 such that fluid displaced from the motor may return to the reservoir by way of the motor line 20 and the return lines 17 and 19.

Should stalling of the vehicle engine or other failure in the control circuits result in the loss of pressure for actuating the motor with the load in an elevated position, it is desirable to lower the load to the ground to permit servicing of the system. Under these conditions, the operator moves the safety valve 121 to position H to vent the pilot system and block communication between lines 113 and 114 as previously described. The operator will then manually open valves 116 and 119 to establish communication between the line 113 and the lines 112 and 117 respectively. The safety valve is then returned to the position shown to establish communication between the line 113 and the line 114.

After the above conditioning has been accomplished, the operator may now control lowering of the load with the pilot control valve 34. This is accomplished by moving the pilot valve to position F which communicates the line 114 with the reservoir by way of the line 34. This permits flow out of the control chambers 54 and 109 so as to generate a pressure differential across the orifices 55 and 110. With the control chamber 54 vented, the load supporting pressure in annular groove 47 acts on the shoulder 53 to urge the valve 50 toward an open position. This communicates the load supporting pressure to the motor line 20, the line 95, the port 98, and the annular groove 100. This pressure in the annular groove acts on the shoulder **106*a* to urge the check valve 106 toward an open position to communicate the load supporting end of the motor with the port 99 and hence to the return line 19 by way of line 96**.

This permits the load 11 to move downward by displacing fluid from the head end of the motor through the flow path just described. Since the motor is contracting, the rod end chamber 15 will be expanding and the displaced fluid returning toward the reservoir through the line 96 is available through the line 87 and the anti-cavitation valve 86 to fill the rod end of the jack and thus avoid cavitation. Once the load 11 is safely lowered, the manually controlled valve 116 and 119 may be moved to the closed position to restore the circuit for normal operation once the failure has been repaired.

When the operator is required to dismount the vehicle with the engine running, he moves safety valve 121 to position H. This establishes communication between the line 122 and the line 123 to vent the control line **39*a* for the relief valve 39. The relief valve may now open at a relatively low pressure to return the output of pump 32 to reservoir 13 by way of line 40. Under these conditions, should the pilot valve 34 be inadvertently moved to one of its operative position, the pressure in the pilot system will not be sufficient to actuate the main control valve 15. This prevents inadvertent movement of the motor and the load 11 to avoid damage to the equipment or injury to personnel. When the operator mounts the vehicle, he returns the safety valve to the position shown to again render the pilot system operative by blocking communication between the lines 122 and 123**.

In view of the foregoing, it is readily apparent that the structure of the present invention provides an improved fluid control system for load supporting fluid motors having positive leakage control. This is accomplished while still retaining safe functional control of the load under both operative and inoperative conditions of the control circuit. This functional desiderata is further achieved with a minimum of cost and without undue complication of the relatively large main control valve.

While the invention has been described and shown with reference to particular embodiments, it will be apparent that variations might be possible that would fall within the scope of the present invention, which is not intended to be limited except as defined in the following claims.

What is claimed is:

1. A fluid control system comprising:

a source of pressurized fluid including a reservoir;

a load supporting fluid motor having a load supporting chamber and an opposed chamber defined by a piston received in a cylinder;

a pilot actuated main control valve responsive to a predetermined minimum pilot pressure to control cummunication between said main source of fluid pressure and said load supporting chamber of said fluid motor for alternately establishing communication of said main source with said load supporting chamber and communication of said load supporting chamber with said reservoir;

a pilot control system including a source of pilot fluid and means including a pilot control valve connected to operate said main control valve;

a relief valve for establishing a predetermined pilot fluid pressure in said pilot control system and including pressure responsive means responsive to said predetermined fluid pressure to open said relief valve and bypass fluid from said pilot control system to said reservoir;

a safety valve disposed in fluid flow controlling relation between said source of pilot fluid and said pilot control valve and having an operative position to permit operation of said pilot system with said predetermined minimum pilot pressure and a safety position to render said pilot control system inoperative;

a load check valve having a control chamber and disposed between said load supporting chamber of said fluid motor and said main control valve so as to permit free flow of fluid from said control valve toward said load supporting end and to normally block fluid flow from said load supporting end toward said control valve;

means responsive to said pilot control system for opening said load check valve in response to pilot actuation of said main control valve to allow fluid flow from said load supporting chamber toward said control valve and said reservoir; and, bypass vent means manually positionable for venting said control chamber via said pilot control valve and permit said load check valve to open in response to fluid pressure in said load supporting chamber in the absence of pilot pressure for actuation of said main control valve.

2. The fluid control system of claim 1 comprising:

a motor line communicating between said main control valve and said load supporting chamber, and said load check valve disposed in said motor line;

a control valve bypass line communicating between said motor line and said reservoir;

an anti-cavitation valve disposed in said control valve bypass line normally positioned to block fluid flow from said motor line toward said reservoir and said opposed chamber; and vent means for selectively venting said anti-cavitation valve and permit said anti-cavitation valve to open and communicate said motor line with said control valve bypass line and said reservoir and said opposed chamber in the absence of pressure in said pilot control system.

3. The fluid control system of claim 2 wherein said vent means includes a manually positionable valve remote from said safety valve; and a vent line communicating said bypass vent means and said manually positionable valve with said reservoir, said safety valve disposed in said vent line so as to block said vent line in said safety position and to open said vent line when in said operative position.

4. The fluid control system of claim 3 wherein said pilot control valve is disposed in said vent line between said safety valve and said reservoir so that opening of said load check valve and said anti-cavitation valve is controlled by moving said pilot control valve to said operative position in the absence of fluid pressure in said pilot control system.

5. A control system for a load supporting hydraulic motor, said system comprising:

a load supporting hydraulic motor;

a source of pressurized fluid;

means including a main control valve operative to selectively communicate fluid between said load supporting hydraulic motor and said source;

a load check valve operatively positioned between said load supporting hydraulic motor and said control valve to permit free flow of fluid from said control valve toward said motor and operative to block fluid flow from said motor to said source;

independent valve means independent of said main control valve for controlling said load check valve to permit said load check valve to be opened in response to fluid pressure in said load supporting motor and allow fluid flow therefrom to be returned to said source;

pilot control means including a pilot control valve and a source of low pressure pilot fluid for actuating said main control valve and said independent valve means; and, safety valve means for blocking communication of pilot fluid to said pilot control valve.

6. The control system of claim 5 wherein said safety valve means includes a first position for communicating said pilot control valve with said load check valve for thereby controlling said load check valve by said pilot control valve when said source of low pressure pilot fluid fails and a second position for blocking communication of said source with said pilot control valve and for blocking communication of said pilot control valve with said load check valve.

* * * * *